United States Patent [19]

Partain

[11] 4,111,300

[45] Sep. 5, 1978

[54] PAPERBOARD WARDROBE CONTAINER

[75] Inventor: James H. Partain, Norcross, Ga.

[73] Assignee: Stone Container Corporation, Chicago, Ill.

[21] Appl. No.: 807,383

[22] Filed: Jun. 17, 1977

[51] Int. Cl.[2] ..... B65D 85/18

[52] U.S. Cl. ..... 206/280; 206/290

[58] Field of Search ..... 206/278, 280, 290, 291, 206/279, 289; 229/23 R, 37 R; 312/259

[56] References Cited

U.S. PATENT DOCUMENTS

| | | | |
|---|---|---|---|
| 2,797,040 | 6/1957 | Belsinger | 229/23 R |
| 2,807,354 | 9/1957 | Belsinger | 206/290 |
| 3,369,652 | 2/1968 | Bebout | 206/280 |

*Primary Examiner*—William T. Dixson, Jr.
*Attorney, Agent, or Firm*—Silverman, Cass & Singer

[57] ABSTRACT

A wardrobe container formed from an integral paperboard blank having a pair of side walls, a pair of end walls and a bottom wall joined together to form a container body opening at its upper end. Each end wall has a top end flap hingedly connected to the upper edge thereof and each side wall has a top end flap hingedly connected only to the upper edge thereof. Each side wall top flap has hanger bar support means cut out from a medial portion of the flap and adapted to be folded and locked into a multiple panel assemblage engaged against the side wall for supporting a conventional hanger bar spanned between the side walls on the interior of the container. Said muliple panel assemblage can be arranged in operating position either on the interior or exterior of the container. Various embodiments of the end wall top flaps are disclosed which cooperate with an end wall for providing access into the interior of the container through a said end wall.

16 Claims, 11 Drawing Figures

PAPERBOARD WARDROBE CONTAINER

BACKGROUND OF THE INVENTION

This invention relates generally to wardrobe containers, and more particularly, to novel support means for a conventional hanger bar integral with the container's paperboard blank and hingedly connected to opposite side walls and cut out from top flaps of the container, said means adapted to be folded into its support position either on the inside or outside of the container.

Wardrobe containers formed from integral paperboard blanks are well known as economical, lightweight and durable structures. The upper end of the container body is designed to support a conventional hanger bar spanned between opposite walls of the container body so that articles of clothing on clothes hangers can be supported from the span of the hanger bar in the interior of the container body. Since the normally thin paperboard walls lack certain strength features for supporting a hanger bar, it has been known to form hanger bar support formations integral with the paperboard blank for rigidifying the container walls intended to support the hanger bar. U.S. Pat. No. 3,369,652, granted to D. R. Bebout, discloses such a wardrobe container with means for supporting the hanger bar.

The herein invention achieves its objectives utilizing selctively cut parts of the top end flaps which function to close off the upper open end of the container body. Also, there are special cuts in the body for access into container. Advantageously economies in fabrication of the container are realized along with the more desirable hanger bar support means which is easier to fold up, gives better appearance and retains more strength in the top and side flaps of the container. Additionally, a more efficient, partial or full access door in an end wall having a built in frame, jamb and attached top end flap which completes the closure in cooperation with another top end flap is realized with the invention.

SUMMARY OF THE INVENTION

A wardrobe container formed from a one-piece prescored foldable blank which includes at least two side walls, two end walls, a bottom wall and two top end flaps connected together. One top flap is hingedly connected along a top free edge of each one of the side walls. Each of the top flaps include hanger bar support means cut out from the flaps of a width and length less than the width and length of the flaps and hingedly connected to the side wall. The support means is foldable separately from the top flap to form multiple panel folded assemblages supported by opposite side walls for supporting a conventional hanger bar on the interior of the container. One of the end walls includes an access panel hingedly connected to the bottom portion of the end wall or to the adjacent side wall. The assemblages can be folded into operating position against either an interior or exterior surface of its adjacent side wall, although the exterior position is preferred.

DESCRIPTION OF THE PREFERRED EMBODIMENT

Figure 1:
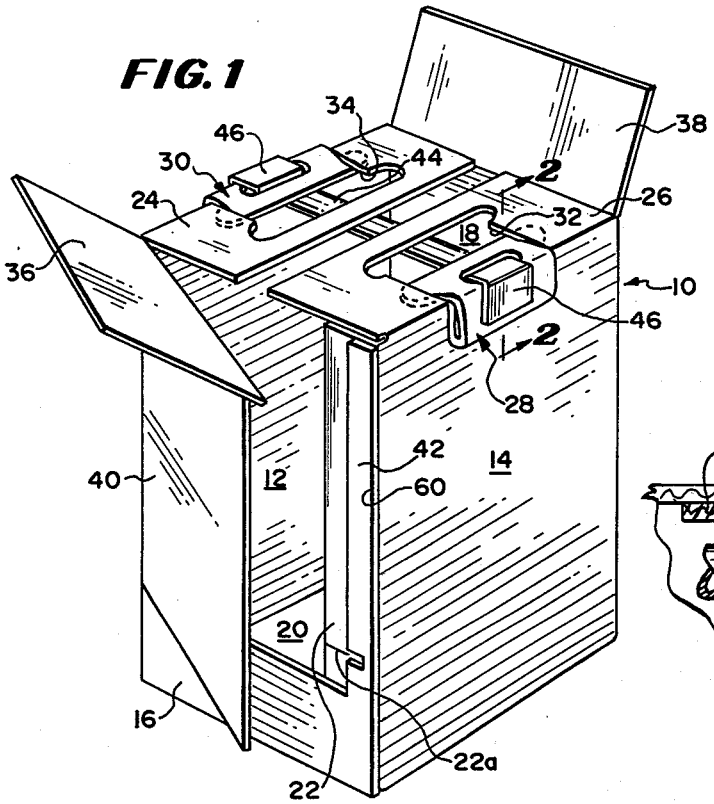
FIG. 1 is a perspective view of the wardrobe container embodying the invention partially assembled, with one embodiment of the access door partially opened.

Referring to FIG. 1, there is illustrated a wardrobe container embodying the invention designated generally by the reference character 10. The container 10 can be erected from integral blanks die-cut from sheeting of paperboard, either corrugated or otherwise, or from other like material by conventional automatic machinery. Wardrobe container 10 includes two side walls 12 and 14, two end walls 16 and 18 and a bottom wall 20 which are conjoined along lines of fold. The side wall 14 has an extension providing a hinged panel 22 which abutts a portion of end wall 16 and which may be assembled thereto with adhesive or other suitable fastening means. Panel 22 has a score line **22*a*** which may be useful in the embodiment of FIG. 7.

Figure 3:
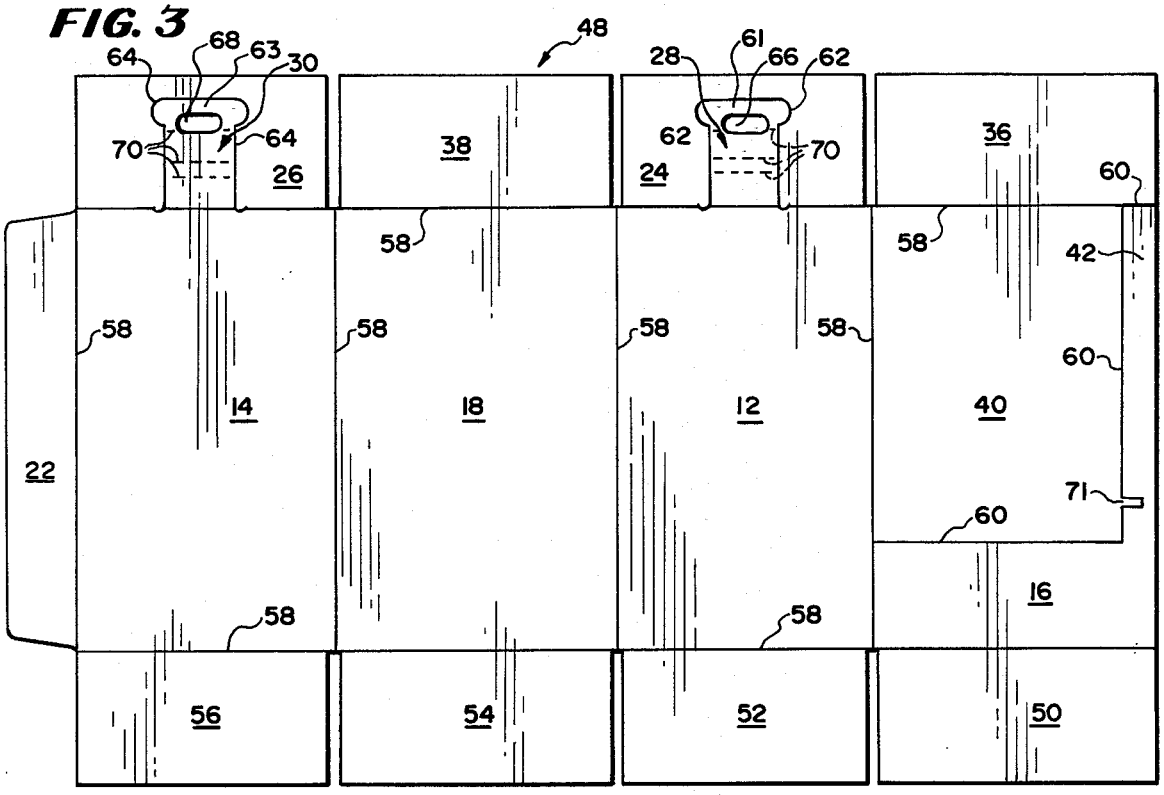
FIG. 3 is a plan view of a carton blank from which the wardrobe container of FIG. 1 can be erected.

A first pair of end flaps 24 and 26 is hingedly connected to the upper edges of side walls 12 and 14 respectively. Each of the end flaps 24 and 26 includes a hanger bar support assemblage or means 28 and 30, partially severable therefrom, as seen in FIG. 3, which are foldable to a position displaced from the plane of the end flaps, leaving the cut outs 32 and 34 seen in FIG. 1. Said means 28 and 30 each is shown engaged against an associated side wall along the exterior surface of the side wall.

A second pair of top end flaps 36 and 38 is provided, adapted to be folded over the first pair of end flaps 24 and 26. The top end flap 36 is hingedly connected to an access panel 40. The access panel 40 is hingedly connected to the side wall 12 and terminates above the bottom portion of the end wall 16 and has a width less than the end wall 16 to leave a narrow end wall portion 42.

Figure 2:
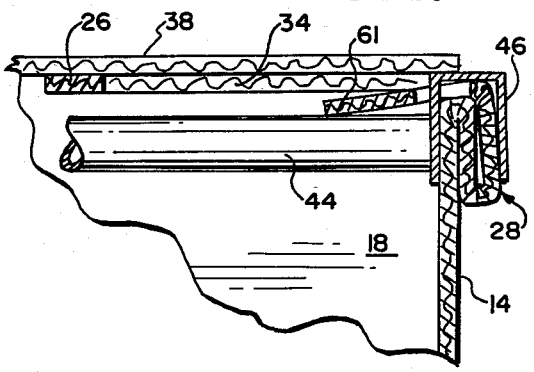
FIG. 2 is a fragmentary sectional view taken along the line 2—2 of FIG. 1 in the direction indicated and showing the hanger bar support means in folded assemblage exterior of the container body.

A hanger bar 44 of conventional design is fitted over the folded hanger bar support assemblages 28 and 30, as illustrated in FIG. 2. The hanger bar 44 includes U-shaped end portions 46 which are secured through the openings 32, 34 over the multiple panel folded assemblage constructed from the folded hanger bar support portion 28, 30. Preferably, the hanger bar support means 28 or 30 will be folded into at least two panels (FIG. 2) to provide sufficient support for the weight of the hanger bar and the supported articles, such as garments which are to be suspended from the bar 44 in the container 10, and on the exterior of the container body. The panel sections 61, 63 are located on the interior of the body.

The wardrobe container 10 preferably is formed from a one-piece blank 48 which is best illustrated in FIG. 3. The bottom wall 20 of the container 10 is formed from four bottom flaps 50, 52, 54 and 56 in a conventional manner. The bottom flaps, top flaps, the side walls and end walls, as well as the side flap 22, are connected along lines of fold 58. The access panel 40 is formed from the end wall 16 along a cut or perforation line 60. The cutout portions 28 and 30 are formed from their respective end flaps 24 and 26 along respective cut or perforation lines 62 and 64. The lines 60, 62 and 64 preferably are not completely cut so that the access panel 40 and the cutout portions 28 and 30 will stay in place until the container 10 is to be assembled.

The portions 28 and 30 have openings 66 and 68, in the panel sections 61 and 63, to which the hanger bar parts 46 are extendable. Thus parts 61, 63 can be engaged beneath edges of the cut out parts 32 and 34 engaged on the bar 44 and cooperate with flaps 24, 26 and 36, 38 to hold down the bar 44 in closed condition of the container. The cut out portions 28 and 30 are displaced from the end flaps 24 and 26 utilizing the holes 66 and 68 and they are then folded into the multiple panel assemblages (FIG. 2) along lines of fold 70 on the outside of the container body. The access panel 40 may be opened along the perforation line 60 by grasping the top flap 36 and a lower cutout panel portion 71.

Figure 4:
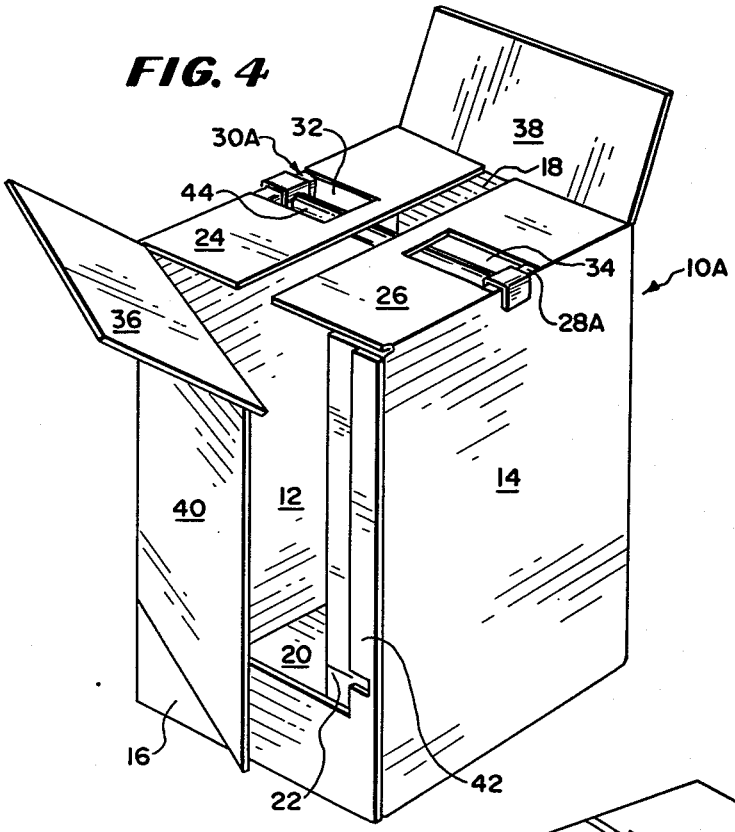
FIG. 4 is a perspective view of the wardrobe container of FIG. 1 but with the support means assembled in the interior of the container body.
Figure 5:
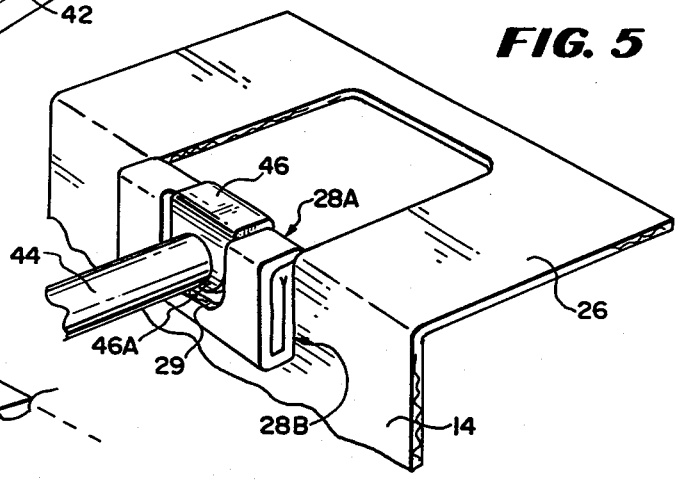
FIG. 5 is an enlarged fragmentary perspective view of the container body showing the support means of FIG. 4 modified for its interior operative position.

Referring to FIG. 4, the container 10A is substantially the same as container 10 except for the disposition of the hanger bar support means 28A and 30A. Instead of being folded on the exterior of the container body, the assemblage 28A seen in FIG. 5, is folded in the interior of the container adjacent side wall 14. The sections are folded as a three-piece sandwich, as seen at 28B with one of the sections having a medial cut out 29 which receives the inside leg 46A of the member 46 so as to prevent lateral shifting of the hanger bar 44 when installed.

Figure 6:
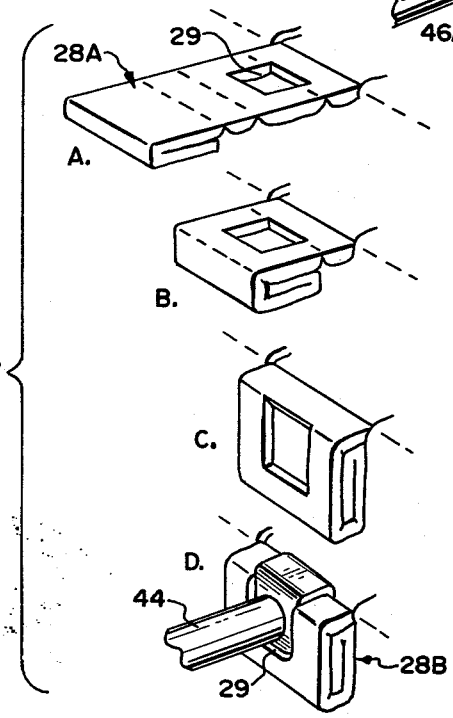
FIG. 6 is a perspective composite view showing the progressive steps for folding the support means into the operative position of FIG. 5.

FIG. 6 illustrates the progressive folding of the assemblage 28A struck from flap 26. The same assemblage is achieved from flap 24 shown in FIG. 4. The sequence of folding starts with the A illustration and progresses to the D illustration of FIG. 6.

Figure 7:
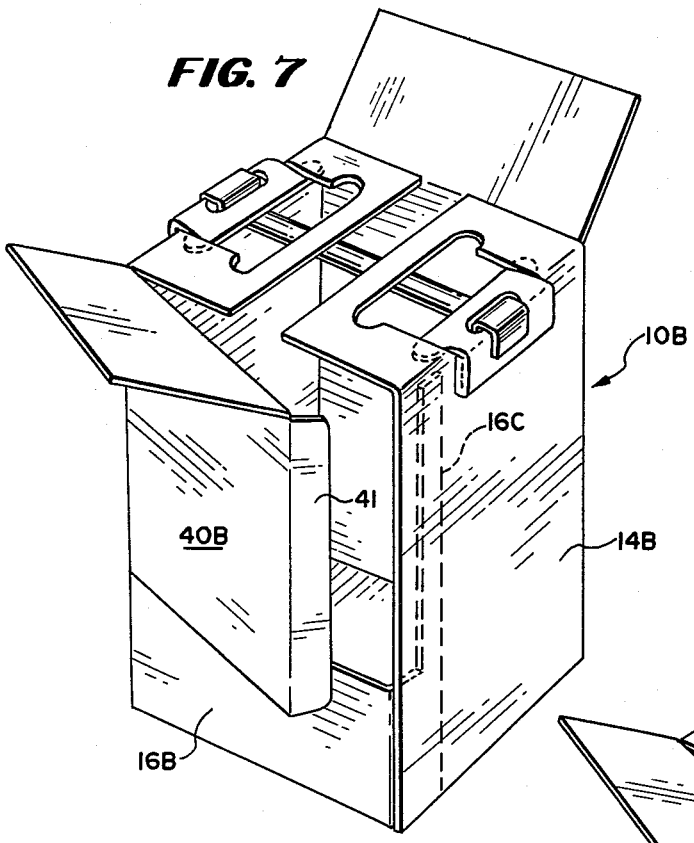
FIG. 7 is a perspective view of the wardrobe container of FIG. 1 but having another modified embodiment of access panel means.

FIG. 7 illustrates a wardrobe container 10B having a modified access panel 40B. Here, the panel 40B has an extension flap 41 and the wall portion 16B has an L-shaped extension flap 16C secured to the inside surface of side wall 14B. The extension 41 is sized to engage against extension 16C in mating edge engagement therewith and abutting the exposed side wall 14B on the interior of the container. Extension 41 would be adhesively secured to the wall 14B.

Figure 8:
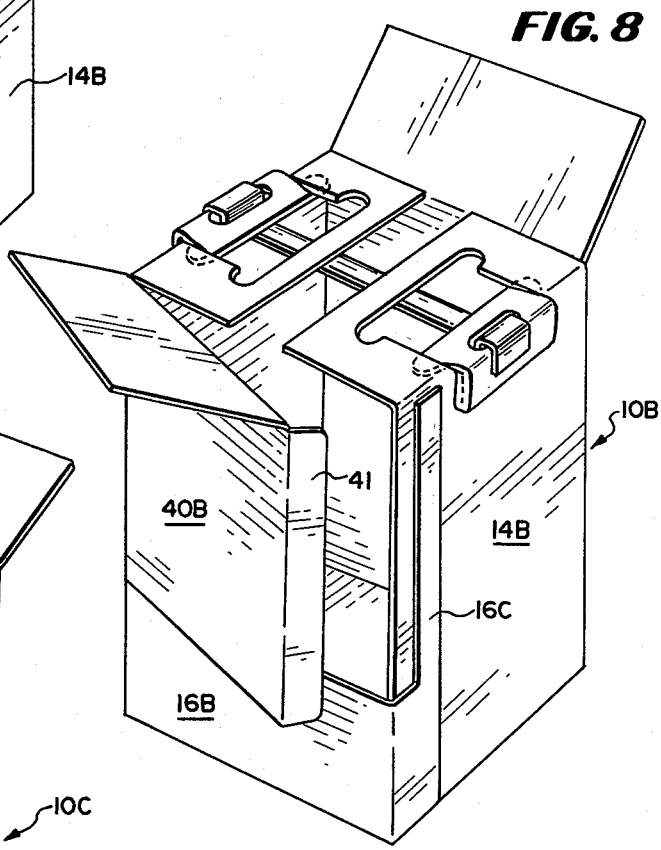
FIG. 8 is a perspective view of the wardrobe container of FIG. 7 but modified for providing another embodiment of access panel means.

FIG. 8 shows the embodiment of FIG. 7 but with the extensions 41 and 16C on the exterior surface of wall 14B.

Figure 9:
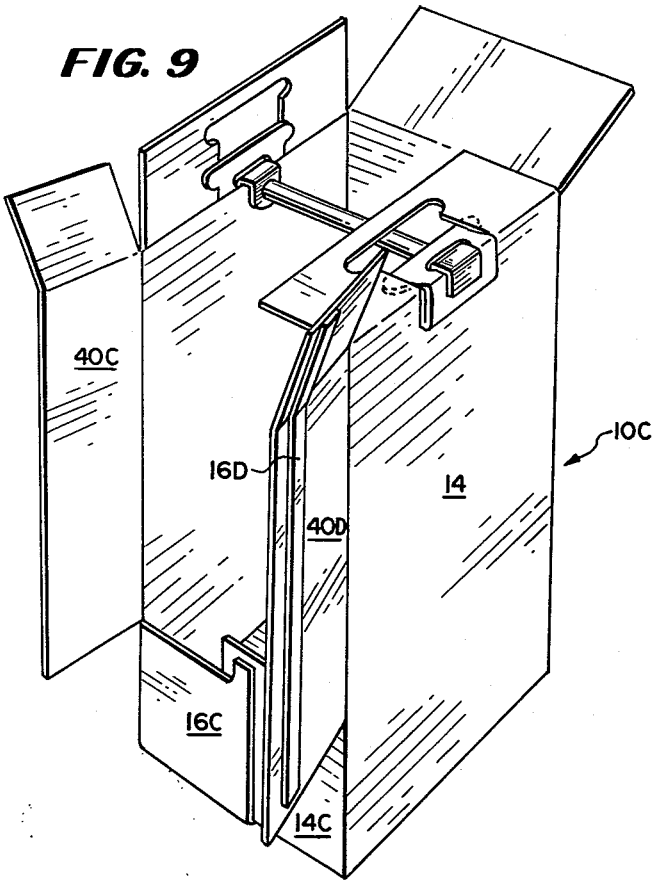
FIG. 9 is a view similar to FIG. 1 but showing another embodiment of access panel means.

FIG. 9 illustrates a wardrobe container 10C having another embodiment for an access panel having two portions 40C and 40D. The wall portion 16C extends part way across the end of the container 10C and overlaps an extension 14C of the side wall 14. The portion 16C has an extension 16D which is cut off and secured to the portion 40D.

Figure 10:
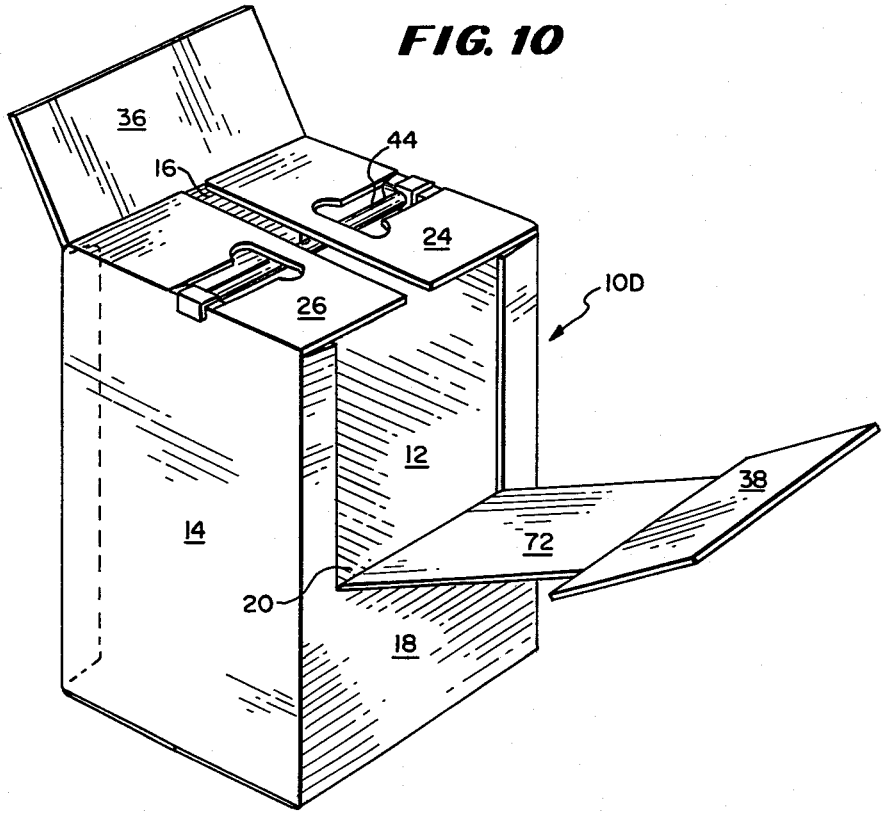
FIG. 10 is a perspective view similar to FIG. 4 but showing another embodiment of access panel means.
Figure 11:
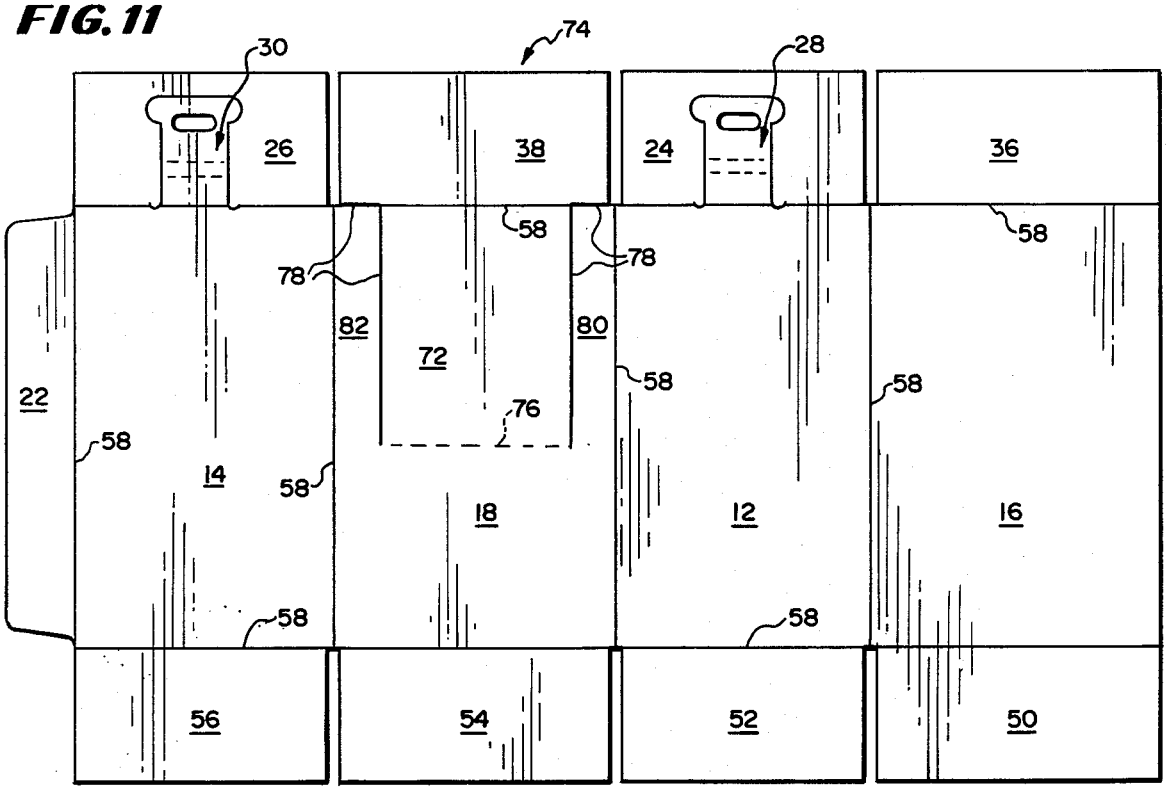
FIG. 11 is a plan view of a carton blank from which the wardrobe container of FIG. 10 can be erected.

The wardrobe container may have a modified access panel 72, most clearly illustrated in FIGS. 10 and 11 for the container 10D. The container blank 74 shown in FIG. 11, as well as the assembled container shown in FIG. 4 are identical in all respects to the container shown in FIGS. 1 and 3 except for the modified access panel 72 and the end walls 16 and 18. The access panel 72 could also be formed in the end wall 16. The hanger bar support means 28 and 30 are identical in all respects with those of the previous figures .

The modified access panel 72 is hingedly connected above the bottom edge of the end wall 18 along a line of fold 76. The access panel 72 is hingedly connected to the top panel 38 along the line of fold 58 and is formed from the end wall 18 along cut or perforation lines 78. The access panel 72 is formed of a width less than the width of the end wall 18 to leave two narrow end wall portions 80 and 82 which provide rigidity to the container 10.

It is to be understood that the invention contemplates implementation thereof in connection with other than the top end flaps of the side walls 12 and 14. The hanger bar support cutout portions may be provided on the top flaps 36 and 38 of the end walls 16 and 18 and the access panel may be provided on the other end wall or on one of the side walls 12 and 14. The respective sizes illustrated are also illustrated as an example, and many other combinations of sizes of the walls and flaps and the corresponding assembled carton are possible within the scope of the invention.

What is desired to be secured by Letters Patent of the United States is:

1. In a wardrobe container formed from a one-piece blank having at least two side walls, two end walls and a bottom wall connected together, and including a hanger bar having opposed end portions each defined by inside and outside legs, the inprovement comprising; a pair of top flaps each hingedly connected along a top free edge of one of said two side walls, each of said top flaps including hanger bar support means formed from said flaps, said support means being hingedly connected to said side wall and being of a length less than the length of said top flap and a width less than the width of said top flap and foldable separately from said top flap along multiple parallel lines of fold substantially parallel to said hinged connection with the side wall into a multiple panel folded assemblage engaged against the side wall, each of said multiple panel folded assemblages including a hole in the center portion of the most interior panel of said assemblage, one end portion of said hanger bar being received over each folded assemblage with the outside leg positioned against the outer surface of the folded assemblage and with the inside leg received within the hole in the most interior panel to prevent lateral shifting thereof; and a first one of said end walls including a hingedly mounted access panel allowing access into said container interior.

2. A container as claimed in claim 1 wherein; each multiple panel folded assemblage includes a first panel having a first edge hingedly connected to the corresponding side wall, and at least one additional panel hingedly connected to a second edge of the first panel parallel to the first edge, said assemblage being foldable against the interior surface of the corresponding side wall with said first panel constituting the most interior panel of said assemblage.

3. A container as claimed in claim 1 wherein; said access panel is hingedly connected to a first one of said side walls and is of a length less than the length of said first side wall and of a width less than the width of said first end wall, leaving a narrow end portion opposite said first side wall hinged connection.

4. A container as claimed in claim 3 including; a second pair of top flaps, one hingedly connected along a top free edge of said second end wall and one hingedly connected along a top free edge of said access panel, foldable over said first pair of top flaps; and said second side wall including a side flap securable to said narrow end portion.

5. A container as claimed in claim 1 wherein; said access panel is hingedly connected to said first end wall along a line of fold substantially perpendicular to said side walls and spaced above said container bottom wall; and said access panel is of a width less than the width of said first end wall, leaving a narrow end wall portion along both sides of said access panel, each connected to one of said side walls.

6. A container as claimed in claim 5 further including; a second pair of top flaps, one hingedly connected along a top free edge of said end wall and one hingedly connected along a top free edge of said access panel, foldable over said first pair of top flaps.

7. A container as claimed in claim 1 wherein; said access panel is hingedly connected to a first one of said side walls and is of a length less than the length of said first side wall and includes an extension flap attached to the edge opposite said hinged connection engaged against said second one of said side walls, said access panel being separated from a bottom wall portion of said first end wall, and said bottom wall portion includes an L-shaped extension flap extending from the edge opposite said hinged connection the length of said container and secured to one surface of said second one of said side walls for mating edge engagement of the extension flap with said access panel.

8. A container as claimed in claim 1 wherein; said one end wall is defined by inner and outer overlapped full height sections, said access panel being formed from the upper overlapped portions of the inner and outer sections and constituting inner and outer overlapping portions each hingedly connected to one of said side walls, the outer of said overlapping access panel portions being of less width than the corresponding end wall outer section, the inner of said overlapping access panel portions having an extension secured thereto along the length thereof for abutment thereagainst by the outer edge of the center of said access panels.

9. In a wardrobe container formed from a one-piece blank having at least two side walls, two end walls and a bottom wall connected together, and including a hanger bar having opposed end portions each defined by inside and outside legs, the improvement comprising; a pair of top flaps each hingedly connected along a top free edge of one of said two side walls, each of said top flaps including hanger bar support means formed from said flap, said support means being hingedly connected to said side wall and being of a length less than the length of said top flap and of a width less than the width of said top flap and foldable separately from said top flap along multiple parallel lines of fold substantially parallel to said hinged connection with the side wall into a multiple panel folded assemblage engaged against the exterior surface of the side wall and defining a cut out within the flap, each of said hanger bar support means including an outermost panel with a hole in a center portion thereof receiving one end portion of said hanger bar therethrough, said outermost panel being folded separately from said folded assemblage and extending inwardly relative to the corresponding side wall, through the cut out in the associated top flap, into underlying engagement with the top flap and overlying engagement with the hanger bar, the received end portion of said hanger bar having the inside and outside legs thereof respectively positioned against the inner surface of the side wall and the outer surface of the folded assemblage; and a first one of said end walls including a hingedly mounted access panel allowing access into said container interior.

10. A container as claimed in claim 9 wherein; each of said outermost panels include lateral extensions from each side of said panel engaged against the interior surface of the corresponding top flap to hold said hanger bar in position.

11. A container as claimed in claim 9 wherein; said access panel is hingedly connected to a first one of said side walls and is of a length less than the length of said first side wall and of a width less than the width of said first end wall, leaving a narrow end wall portion opposite said first side wall hinged connection.

12. A container as claimed in claim 11 including; a second pair of top flaps, one hingedly connected along a top free edge of said second end wall and one hingedly connected along a top free edge of said access panel, foldable over said first pair of top flaps; and said second side wall including a side flap securable to said narrow end wall portion.

13. A container as claimed in claim 9 wherein; said access panel is hingedly connected to said first end wall along a line of fold substantially perpendicular to said side walls and spaced above said container bottom wall; and said access panel is of a width less than the width of said first end wall, leaving a narrow end wall portion along both sides of said access panel, each connected to one of said side walls.

14. A container as claimed in claim 13 further including; a second pair of top flaps, one hingedly connected along a top free edge of said end wall and one hingedly connected along a top free edge of said access panel, foldable over said first pair of top flaps.

15. A container as claimed in claim 9 wherein; said access panel is hingedly connected to a first one of said side walls and is of a length less than the length of said first side wall and includes an extension flap attached to the edge opposite said hinged connection engaged against said second one of said side walls, said access panel being separated from a bottom wall portion of said first end wall, and said bottom wall portion includes an L-shaped extension flap extending from the edge opposite said hinged connection the length of said container and secured to one surface of said second one of said side walls for mating edge engagement of the extension flap with said access panel.

16. A container as claimed in claim 9 wherein; said one end wall is defined by inner and outer overlapped full height sections, said access panel being formed from the upper overlapped portions of the inner and outer sections and constituting inner and outer overlapping portions each hingedly connected to one of said side walls, the outer of said overlapping access panel portions being of less width than the corresponding end wall outer section, the inner of said overlapping access panel portions having an extension secured therto along the length thereof for abutment thereagainst by the outer edge of the center of said access panels.

* * * * *